United States Patent [19]

Abe

[11] Patent Number: 4,993,587

[45] Date of Patent: Feb. 19, 1991

[54] CARD DISPENSING APPARATUS FOR CARD VENDING MACHINE

[75] Inventor: Hiroshi Abe, Tokyo, Japan

[73] Assignee: Asahi Seiko Kabushiki Kaisha, Tokyo, Japan

[21] Appl. No.: 343,898

[22] Filed: Apr. 26, 1989

[30] Foreign Application Priority Data

May 9, 1988 [JP] Japan ..... 63-60147[U]

[51] Int. Cl.[5] ..... B65H 3/06; B65H 3/52

[52] U.S. Cl. ..... 221/21; 221/231; 221/251; 271/122

[58] Field of Search ..... 221/231, 251, 259, 21; 271/122

[56] References Cited

U.S. PATENT DOCUMENTS

| | | | |
|---|---|---|---|
| 4,494,747 | 6/1985 | Stefansson | 271/122 X |
| 4,522,385 | 1/1985 | Graef et al. | 221/251 X |
| 4,548,395 | 10/1985 | Snellman et al. | 271/122 X |
| 4,717,043 | 1/1988 | Groover et al. | 221/231 X |

*Primary Examiner*—F. J. Bartuska

*Attorney, Agent, or Firm*—James E. Nilles

[57] ABSTRACT

A card dispensing apparatus is disclosed of a type comprising a draw roller for drawing a card to be dispensed from a bottom of a stack of cards and a delivery roller for delivering the drawn card toward an outlet of the apparatus. The card dispensing apparatus further comprises an antidoubling roller positioned above the delivery roller and reversely rotated relative to the delivery roller to preventing an upper card of two overlapped cards from delivering to the outlet.

4 Claims, 3 Drawing Sheets

CARD DISPENSING APPARATUS FOR CARD VENDING MACHINE

BACKGROUND OF THE INVENTION

1. Field of the Invention

The present invention relates to a card dispensing apparatus used in card vending machines for dispensing telephone cards or the like.

2. Description of the Prior Art

Recently, there are generally used cards for paying a telephone charge, a traffic fare and others. A vending machine for selling such a card comprises a card dispensing apparatus arranged for delivering a card from a stack of cards one at a time.

There has been a card dispensing apparatus comprising a vertical store room defined between two parallelly spaced side plates for holding a stack of cars, a draw roller positioned under the stack for drawing out a card from the bottom of the stack and a delivery roller for delivering the drawn card to an outlet.

Such a card dispensing apparatus has a disadvantage that two overlapped cards might be delivered out at a time.

SUMMARY OF THE INVENTION

An object of the present invention is to provide a card dispensing apparatus adapted for preventing two overlapped cards from delivering at a time.

According to the present invention, there is provided a card dispensing apparatus comprising a vertical store room defined between two parallelly spaced side plates for holding a stack of cards, a draw roller positioned under the stack for drawing out a card from the bottom of the stack, a delivery roller for delivering the drawn card towards an outlet and a card antidoubling roller positioned above the delivery roller and driven in an opposite direction relative to a rotational direction of the delivery roller.

The card antidoubling roller according to the present invention may be rotatably mounted on a roller shaft rotated in the opposite direction relative to the rotational direction of the delivery roller and has an engaging arm extended in the axial direction from an end of the antidoubling roller while the roller shaft has a driving pin extended in a radial direction such as to engage the engaging arm to drive the antidoubling roller.

In a preferred embodiment of the invention, the draw roller is rotatably mounted on a driving shaft and is drivingly connected to the driving shaft through an electromagnetic clutch. The draw roller may have an arch shaped peripheral protrusion extended over the half of the outer periphery and the peripheral protrusion has peripheral indentations to be frictionally engaged with a bottom surface of a card at the bottom of the stack during rotation of the draw roller.

BRIEF DESCRIPTION OF THE DRAWINGS

The present invention will become apparent as the following description of illustrative embodiment proceeds with reference to the drawings, in which.

DESCRIPTION OF THE PREFERRED EMBODIMENTS

Figure 1:
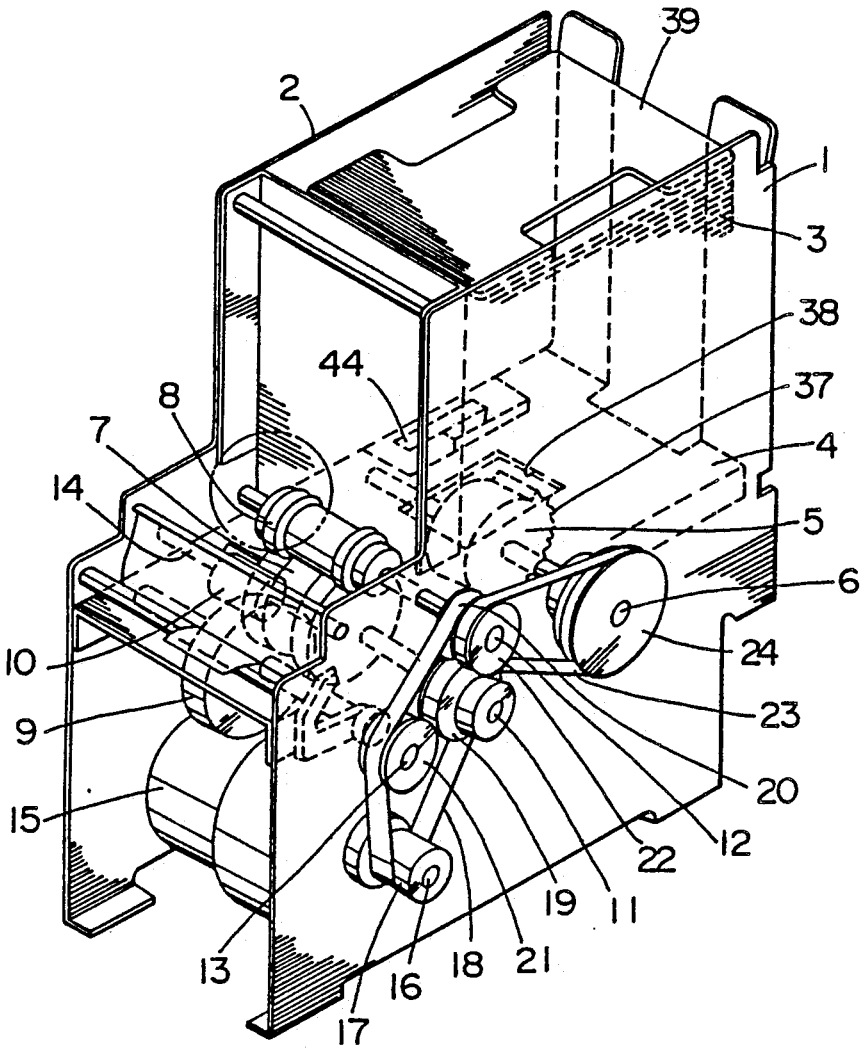
FIG. 1 is a perspective view of the card dispensing apparatus according to the invention.
Figure 3:
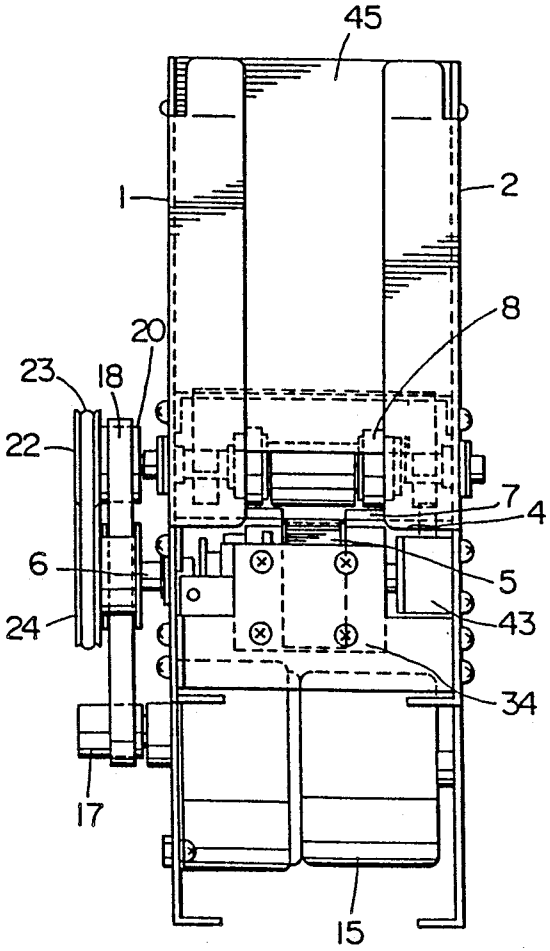
FIG. 3 is a rear elevation of the apparatus taken from line III—III of FIG. 2.
Figure 2:
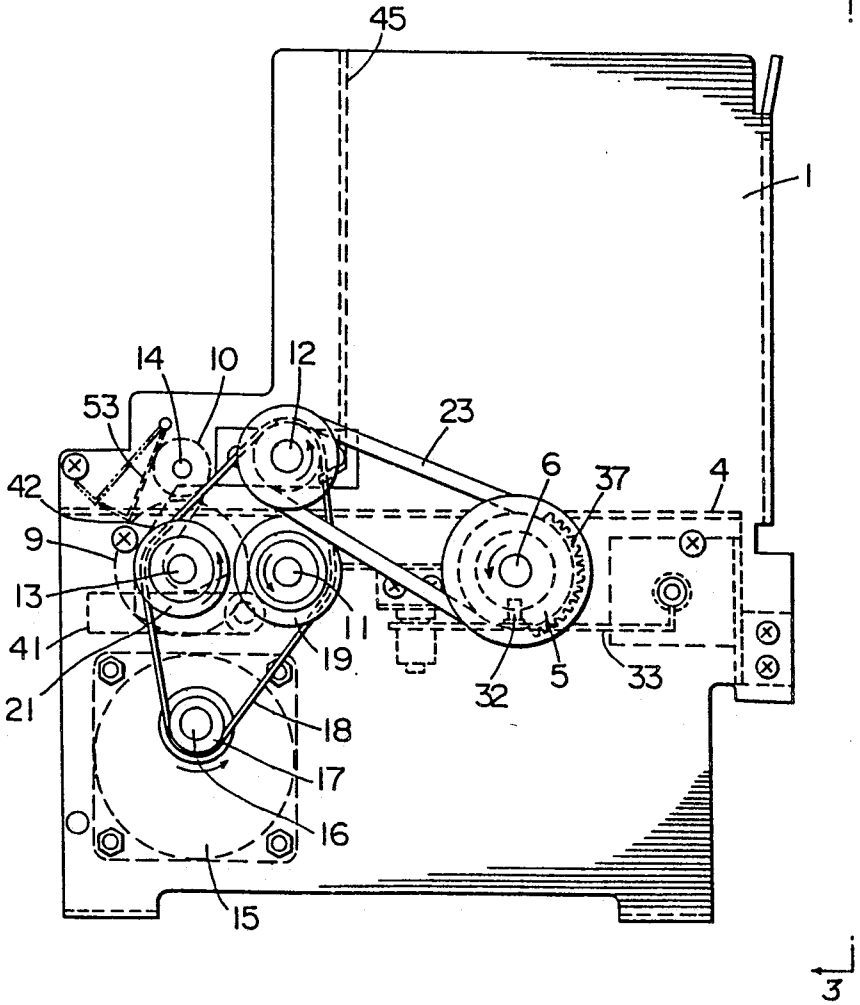
FIG. 2 is a side elevation of the apparatus of FIG. 1.

With reference to drawings illustrating an embodiment according to the present invention, it will be seen from the prespective view of FIG. 1 that a vertical store room is defined between two parallelly spaced side plates 1 and 2 and holds a stack 3 of cards supported by a stationary supporting plate 4. There is provided under the supporting plate 4 a draw roller means including a draw roller 5 which is rotatably mounted on a driving shaft 6. The driving shaft is rotatably supported at the opposite ends by means of a pair of bearings on the side plates 1 and 2, respectively.

A delivery roller means including a delivery roller 7 is arranged in front of the draw roller 5, and an antidoubling roller means including an antidoubling roller 8 is disposed above the deliver roller 7. Further a pair of discharging pinch rollers 9 and 10 are arranged at the outlet of the apparatus. Each of roller shafts 11 to 14 of these rollers 7 to 10 is rotatably supported by means of bearings on the side plates 1 and 2, respectively.

In order to drive the above mentioned rollers, there is provided an electric motor means 15 having a motor shaft 16 provided with a pulley 17. The pulley 17 is drivingly connected by means of a belt 18 to pulleys 19, 20 and 21 on the roller shafts 11, 12 and 13 and a pulley 22 secured to the roller shaft 12 is drivingly connected by means of a belt 23 to a pulley 24 on the driving shaft 6.

In order to prevent overlapped cards from delivering at a time the upper antidoubling roller 8 is rotatbly mounted on the roller shaft 12 while the lower delivery roller 7 is fixed on the roller shaft 11 The antidoubling roller 8 has a free rotation means which includes an engaging arm 50 extended in the axial direction from an end thereof, while the roller shaft 12 has a driving pin 51 extended radially therefrom so as to engage the engaging arm 50 to rotate the antidoubling roller 8 together with the roller shaft. The antidoubling roller 8 is rotated in the opposite direction relative to the rotational direction of the delivery roller 7.

The lower discharging pinch roller 9 at the outlet is fixed to the roller shaft 13 which is driven to rotate in a card discharging direction and the upper discharging pinch roller 10 is rotatably supported by the roller shaft 14 so as to cooperate with the lower pinch roller 9.

The draw roller 5 has an arch shaped peripheral protrusion 37 of a urethane rubber extended along substantially the half of the outer periphery e.g. an arch of 135 degrees and the peripheral protrusion 37 has peripheral indentations to frictionally engage the bottom surface of a card at the bottom of the stach 3.

Figure 6:
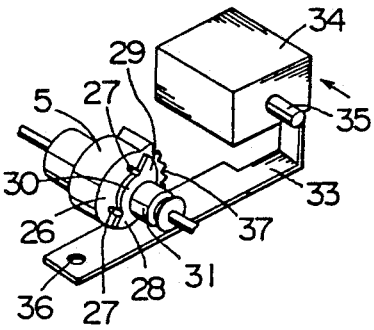
FIG. 6 is a schematic perspective view illustrating a draw roller.
Figure 8:
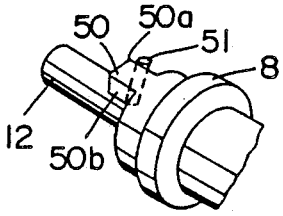
FIG. 8 is a perspective view showing a driving engagement between the antidoubling roller and its roller shaft.
Figure 7:
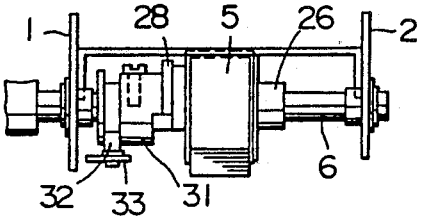
FIG. 7 is a side view of the draw roller of FIG. 6.

Referring to FIG. 6, the draw roller 5 is integrally formed with a clutch roller 26 which is rotatably mounted on the driving shaft 6. The clutch roller 26 has three clutch pins 27 which are circumferentially spaced from each other on one end surface of the clutch roller and resiliently retractably extended by means of springs (not shown) from receiving holes opened at the end surface, respectively. A clutch slide ring 31 is slidably mounted on the driving shaft 6 at a side adjacent to the end surface of the clutch roller 26 and is connected to the driving shaft 6 by means of a key so as to be rotated by the driving shaft. The clutch slide ring 31 is integrally formed with a driving cam 30 which has two pawls 28 and 29 circumferentially opposed such as to engage one of the clutch pins 27 to drivingly connect the draw roller 5 to the driving shaft when the slide ring 31 is slid towards the clutch roller 26 to push one or two of the three clutch pins 27 into its receiving hole and abut on the end surface. In order to slide the clutch slide ring 31 there is a clutch lever 33 (FIG. 6) having a clutch lever pin 32 (FIG. 7) which is engaged a circumferential groove formed in the clutch slide ring 31. The clutch lever 33 is connected at one end thereof to a movable piece 35 of an electromagnetic solenoid 34 and is pivoted at another end to a pivot pin, not shown, which extends through hole 36 in lever 33.

In operation, the electric motor 15 is powered to rotate the driving shaft 6 and the roller shafts 11, 12 and 13 and the solenoid 34 is energized to actuate the movable piece 35 to thereby slide the clutch slide ring 31 with the driving cam 30 towards the clutch roller 26 to drivingly connect the draw roller 5 to the driving shaft. Thus the draw roller 5 is rotated in the delivery direction by the driving shat 6 and then the peripheral protrusion 37 with peripheral indentations protrudes into the store room through an opening 38 in the supporting plate 4 to frictionally engage the bottom surface of a card at the bottom of the stack 3 and whereby the bottom card is drawn from the bottom of the stack 3 which is pressed down by a weight 39.

If two overlapped cards are drawn from the bottom of the stack 3 by the draw roller 5, the upper card will thereafter shift relative to the lower card, because the lower card is engaged with the lower delivery roller 7 which advances and delivers it towards the outlet 40, while the upper card is stopped by the upper antidoubling roller 8 which is reversely rotated to thereby prevent from delivering the upper card towards the outlet. On the other hand if the upper card forwardly shifts relative to the lower card, then the upper card is engaged with the lower delivery roller 7 which advances it towards the outlet 40 and subsequently the lower card is also engaged with the lower delivery roller 7 and is advanced towards the outlet 40 by the deliver roller 7. If the two cards are inserted between the lower and upper rollers 7 and 8, an overload signal is generated by conventional overload signal generation means, not shown, to reverse the electric motor 15 whereby the lower delivery roller is reversely rotated by its roller shaft 11 while the upper antidoubling roller 8 is not driven by its roller shaft 12 since the driving pin 51 on the roller shaft 12 which is now forwardly rotated disengages from the engaging arm 50 on the antidoubling roller 8 until the roller shaft 12 has been rotated one revolution so that the two overlapped cards are returned backwardly to an aligned position at the bottom of the stack by the delivery roller and the draw roller which is also reversely driven. Subsequently, the electric motor is again normally rotated to dispense one card.

Figure 4:
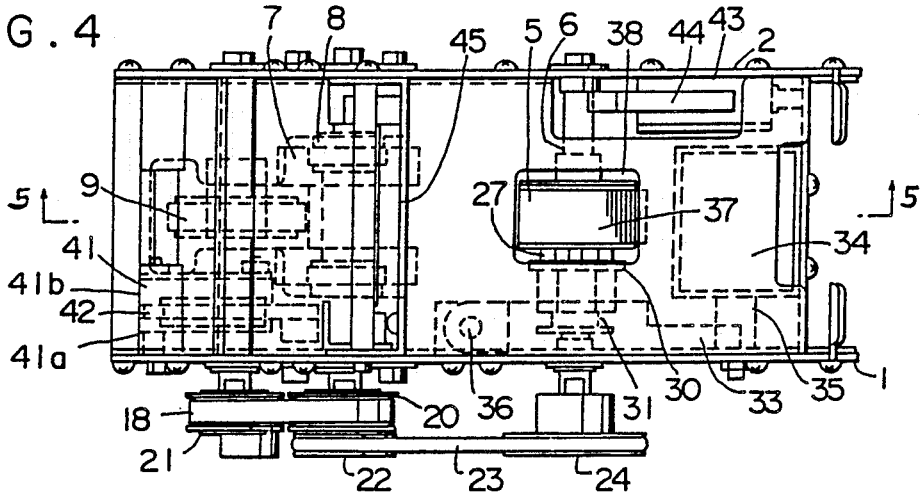
FIG. 4 is a plan view of the apparatus of FIG. 2.
Figure 5:
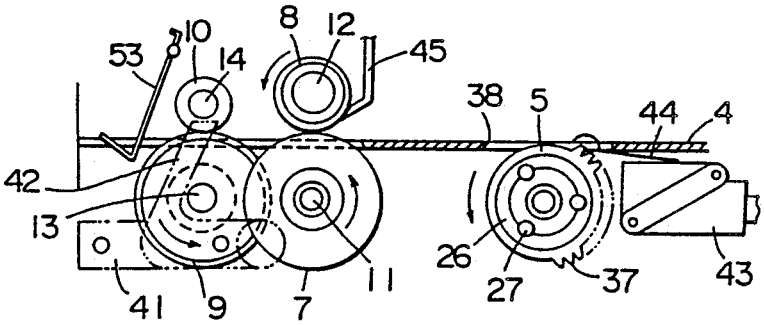
FIG. 5 is a sectional view taken along a line V—V in FIG. 4.

In the emboidment, as shown in FIG. 4, there is provided at the outlet 40 a photoelectric sensor 41 comprising a transmitter 41*a* and a receiver 41*b* and an actuator 42 which is pivoted and urged to normally protrude into a passage of the card to be dispensed at the outlet 40 so that the actuator 42 is pushed down by the card to move between the transmitter 41*a* and the receiver 41*b* and whereby the sensor 41 detects the dispensation of one card. A shutter 53 is pivoted to a frame at the outlet 40 such as to be outwardly open by the card to be dispensed, but prevent the shutter from being unfaily opened from the outside.

In the drawings, 43 designates an empty detecting microswitch having a switch arm 44 and 45 designates a stopper plate for the cards.

What is claimed is:

1. A card dispensing apparatus for card vending machines comprising a vertical store room defined between two parallelly spaced side plates for holding a stack of cars, a draw roller positioned under the stack for drawing out a card from the bottom of the stack, a delivery roller for delivering the drawn card towards an outlet, a card antidoubling roller positioned just above the delivery roller, and a reversible motor for reversibly rotating the rollers, the antidoubling roller being rotatably mounted on a reversible roller shaft rotated in the opposite direction relative to the rotational direction of the delivery roller and including an end and an engaging arm extending in the axial direction from the end of the antidoubling roller, the reversible roller shaft having a driving pin extended in a radial direction such as to engage the engaging arm to drive the antidoubling roller.

2. An apparatus according to claim 1, wherein the draw roller is rotatably mounted on a drive shaft and is drivingly connected to the drive shaft through an electromagnetic clutch which includes a clutch roller formed integrally with the draw roller said clutch roller having an end surface and receiving holes circumferentially spaced from each other on the end surface of the clutch roller, a plurality of clutch pins mounted to retractably extend from the receiving holes in the end surface, respectively, a clutch slide ring slidably mounted on the drive shaft at a side adjacent to the end surface of the clutch roller and connected to the drive shaft so as to be rotated together with the drive shaft, a driving cam formed integrally with the clutch slide ring and having two circumferentially spaced pawls, and an electromagnetic solenoid for actuating the clutch slide ring to slide it towards the clutch roller to thereby engage one of the pawls with one of the clutch pins to drivingly connect the draw roller to the drive shaft to thereby rotate the draw roller in the forward or reverse direction when the electromagnetic solenoid is energized and the drive shaft is rotated in the forward or reverse direction.

3. A card dispensing apparatus for card vending machines comprising a vertical store room defined between two parallelly spaced side plates for holding a stock of cards, a reversible draw roller positioned under the stack for drawing out a card from the bottom of the stack, a reversible delivery roller for delivering the drawn card towards an outlet, a card antidoubling roller positioned above the delivery roller, and a reversible motor for reversibly rotating the rollers, the card antidoubling roller being rotatbly mounted on a reversible roller shaft rotated in the opposite direction relative to the rotational direction of the delivery roller and having an engaging arm extended in the axial direction from an end of the antidoubling roller, the reversible roller shaft having a driving pin extended in a radial direction such as to engage the engaging arm to drive the antidoubling roller to cause two overlapped cards inserted between said delivery and antidoubling rollers to be returned to an aligned position at the bottom of the stack of cards upon the reverse rotation of the reversible motor.

4. A card dispensing apparatus for card vending machines comprising a vertical store room defined between two parallelly spaced side plates for holding a stack of cards; a draw roller means including a draw roller mounted under said stack for drawing out a card from the bottom of the stack; a delivery roller means including a delivery roller mounted for rotation either in one direction for delivering said drawn card towards an outlet or in a reverse direction for delivering a card back to said stack; a card antidoubling roller means including an antidoubling roller mounted above said delivery roller on a reversible roller shaft rotatable in an opposite direction relative to the rotational direction of said delivery roller; a reversible motor means mounted for selectably rotating said delivery and antidoubling rollers in reverse directions; an overload signal sensing means operative to generate an overload signal to reverse said motor means when a plurality of cards are inserted between said delivery and antidoubling rollers; and free rotation means operatively interconnected between said reversible roller shaft and said antidoubling roller to permit continued limited rotation in said opposite direction upon reverse rotation of said motor means in response to said overload signal so that said plurality of cards are returning to an aligned position at the bottom of said stack of cards.

* * * * *